US005632252A

United States Patent [19]

Hyodo et al.

[11] Patent Number: 5,632,252

[45] Date of Patent: May 27, 1997

[54] APPARATUS FOR CONTROLLING FUEL EVAPORATED FROM INTERNAL COMBUSTION ENGINE

[75] Inventors: Yoshihiko Hyodo; Hiroki Matsuoka, both of Susono, Japan

[73] Assignee: Toyota Jidosha Kabushiki Kaisha, Aichi, Japan

[21] Appl. No.: 599,214

[22] Filed: Feb. 9, 1996

[30] Foreign Application Priority Data

Feb. 13, 1995 [JP] Japan ..... 7-023878

[51] Int. Cl.[6] ..... F02M 25/08

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 4,887,578 | 12/1989 | Woodcock et al. | 123/520 |
| 5,056,494 | 10/1991 | Kayanuma | 123/516 |
| 5,143,041 | 9/1992 | Franzke | 123/516 |
| 5,209,210 | 5/1993 | Ikeda et al. | 123/516 |
| 5,445,133 | 8/1995 | Nemoto | 123/520 |
| 5,456,236 | 10/1995 | Wakashiro et al. | 123/519 |
| 5,456,237 | 10/1995 | Yamazaki et al. | 123/519 |
| 5,456,238 | 10/1995 | Horiuchi et al. | 123/520 |
| 5,460,136 | 10/1995 | Yamazaki et al. | 123/519 |
| 5,477,836 | 12/1995 | Hyodo et al. | 123/520 |
| 5,487,369 | 1/1996 | Hara et al. | 123/520 |

FOREIGN PATENT DOCUMENTS

| | | |
|---|---|---|
| 63-198462 U | 12/1988 | Japan . |
| 552134A | 3/1993 | Japan . |

*Primary Examiner*—Thomas N. Moulis
*Attorney, Agent, or Firm*—Kenyon & Kenyon

[57] ABSTRACT

An apparatus for controlling the evaporated fuel of an internal combustion engine secures the working capacities of the canisters and properly controls an air-fuel ratio when resuming the purging of evaporated fuel into the engine.

The apparatus has the first and second canisters for adsorbing evaporated fuel produced in a fuel tank. The canisters are connected in series between an atmospheric hole of the first canister and an intake duct of the engine. Air from the atmospheric hole passes through the canisters and releases the fuel adsorbed by the canisters. The air and released fuel are purged into the intake duct. During the operation of the engine, a path guides evaporated fuel from the fuel tank into an adsorption material disposed in the second canister, so that the fuel adsorption state of the adsorption material is substantially unchanged between a given purge operation and the next purge operation around a path for purging air and fuel from the second canister into the intake duct. The apparatus also has a fuel supply controller that uses the concentration of purged fuel of a first purge operation when calculating, at a second purge operation, a fuel injection quantity to achieve a target air-fuel ratio.

2 Claims, 13 Drawing Sheets

APPARATUS FOR CONTROLLING FUEL EVAPORATED FROM INTERNAL COMBUSTION ENGINE

BACKGROUND OF THE INVENTION

1. Field of the Invention

The present invention relates to an apparatus for controlling fuel evaporated from an internal combustion engine, and particularly, to one that is capable of securing the working capacity of the engine and of properly controlling an air-fuel ratio when the purging of evaporated fuel from a fuel tank into the engine is resumed.

2. Description of the Related Art

A canister having an activated carbon layer is used to adsorb evaporated fuel produced in a fuel tank of an internal combustion engine. The adsorbed fuel is released from the layer by air passed through the layer and is supplied into an intake duct of the engine. If the canister is used alone, the adsorbing capacity, i.e., working capacity thereof will be insufficient to adsorb evaporated fuel, and a large amount of evaporated fuel will be purged from the fuel tank into the engine when the engine is started, thereby deteriorating the driveability of the engine and the quality of the exhaust gas. To solve this problem, Japanese Unexamined Utility Model Publication 63-198462 has proposed an apparatus for controlling evaporated fuel employing a main canister and a sub-canister connected in series.

As the level of fuel in a fuel tank approaches the bottom, the fuel tank produces a lot of evaporated fuel, which is adsorbed by the main and sub-canisters of this prior art system up to the working capacities thereof. As a result, the canisters may have no space to accept more evaporated fuel. When the fuel tank is replenished with fuel and the engine is restarted, the main canister releases the adsorbed fuel into the sub-canister that is full of adsorbed fuel. Accordingly, a large amount of released fuel is supplied into the engine.

To solve this problem, Japanese Unexamined Patent Publication 6-10996 of this applicant has proposed an apparatus for controlling evaporated fuel of an internal combustion engine, which guides, when a fuel tank is replenished with fuel, evaporated fuel from the fuel tank into a main canister, and when the engine is restarted, into an intake duct of the engine through an evaporated fuel path that bypasses the main canister and a sub-canister. This prior art is capable of securing the working capacities of the canisters because no evaporated fuel is guided from the fuel tank to these canisters during the operation of the engine.

According to this prior art, an adsorption material in the sub-canister adsorbs evaporated fuel around a path between the sub-canister and the intake duct during the operation of the engine. This results in changing the quantity of fuel adsorbed by the sub-canister between a given purge operation and the next purge operation. Namely, the concentration of fuel to be purged into the engine is unknown when a given purge operation is started. If the concentration of purged fuel is unclear, it is difficult to correctly calculate a fuel injection quantity that is essential to carry out feedback control to attain a target air-fuel ratio. This deteriorates the driveability of the engine and the quality the exhaust gas.

To solve this problem, Japanese Unexamined Patent Publication 5-52134 has proposed an apparatus for controlling fuel supply to an internal combustion engine, which gradually opens a purge control valve that guides fuel released from a canister into an intake duct of the engine. If the purge control valve is fully opened at the start of the purging of fuel from the canister into the intake duct, an air-fuel ratio will be too rich and will deteriorate the driveability of the engine and the quality of an exhaust gas. Accordingly, this prior art gradually opens the purge control valve until the concentration of purged fuel is correctly detected.

This prior art system takes a long time to detect the concentration of purged fuel. During this period, the purge control valve must gradually be opened, and therefore, the canister must hold a large amount of adsorbed fuel. Namely, it takes a long time to release the adsorbed fuel from the canister and recover the working capacity thereof. In the meantime, the adsorbed fuel uniformly diffuses through an activated carbon layer of the canister, to reduce the concentration of adsorbed fuel in the layer. Then, the adsorbed fuel hardly leaves the layer, deteriorating the working capacity of the canister. As a result, a large amount of evaporated fuel is purged into the engine at the start of the purge operation, to provide a rich air-fuel ratio and deteriorate the driveability of the engine and the quality of the exhaust gas.

SUMMARY OF THE INVENTION

An object of the present invention is to provide an apparatus for controlling the evaporated fuel of an internal combustion engine, capable of securing the working capacities of canisters and properly carrying out the feedback control of an air-fuel ratio after resuming a purge operation of the evaporated fuel.

In order to accomplish the object, the present invention provides an apparatus for controlling the evaporated fuel of an internal combustion engine shown in FIG. 1. The apparatus has a first canister 13 and a second canister 15 for adsorbing evaporated fuel produced in a fuel tank 21. The canisters 13 and 15 are connected in series between an atmospheric hole in the canister 13 and an intake duct 4 of the engine 1. Air from the atmospheric hole passes through the canisters 13 and 15 and releases the fuel adsorbed by the canisters 13 and 15. The air and released fuel are purged into the intake duct 4. When the fuel tank 21 is replenished with fuel, a first path 20 guides evaporated fuel from the fuel tank 21 to the canister 13. During the operation of the engine 1, a second path 23 guides evaporated fuel from the fuel tank 21 into an adsorption material 14 disposed in the canister 15, so that the fuel adsorption state of the adsorption material 14 is substantially unchanged between a given purge operation and the next purge operation around a path 29 for purging air and fuel from the canister 15 into the intake duct 4, i.e., in the area A. The apparatus has a fuel supply controller that uses the concentration of purged fuel of a first purge operation when calculating, at a second purge operation, a fuel injection quantity to achieve a target air-fuel ratio.

According to this arrangement, the second path 23 directly guides evaporated fuel from the fuel tank 21 into the adsorption material 14 of the second canister 15 during the operation of the engine 1. As a result, the fuel adsorption state of the adsorption material 14 around the path for purging air and fuel from the adsorption material 14 into the intake duct 4 is substantially unchanged between a first purge operation and a second purge operation. Accordingly, the fuel supply controller can use the concentration of purged fuel of the first purge operation when calculating, at the second purge operation, a fuel injection quantity to properly carry out feedback control for achieving a target air-fuel ratio.

In an internal combustion engine having a first canister 13 and a second canister 15 for adsorbing evaporated fuel produced in a fuel tank 21, the canisters 13 and 15 being connected in series between an atmospheric hole of the canister 13 and an intake duct 4 of the engine 1 so that air from the atmospheric hole passes through the canisters 13 and 15 and releases the fuel adsorbed by the canisters 13 and 15 and so that the air and released fuel are purged into the intake duct 4. A method of controlling evaporated fuel according to the present invention includes the steps of guiding, while the fuel tank 21 is being replenished with fuel, evaporated fuel from the fuel tank 21 to the canister 13 through a first path 20; guiding, during the operation of the engine 1, evaporated fuel from the fuel tank 21 to an adsorption material 14 disposed in the canister 15 through a second path 23, so that the fuel adsorption state of the adsorption material 14 is substantially unchanged between a given purge operation and the next purge operation around a path for purging air and fuel from the canister 15 into the intake duct 4; and using the concentration of purged fuel of a first purge operation when calculating, at a second purge operation, a fuel injection quantity to achieve a target air-fuel ratio.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
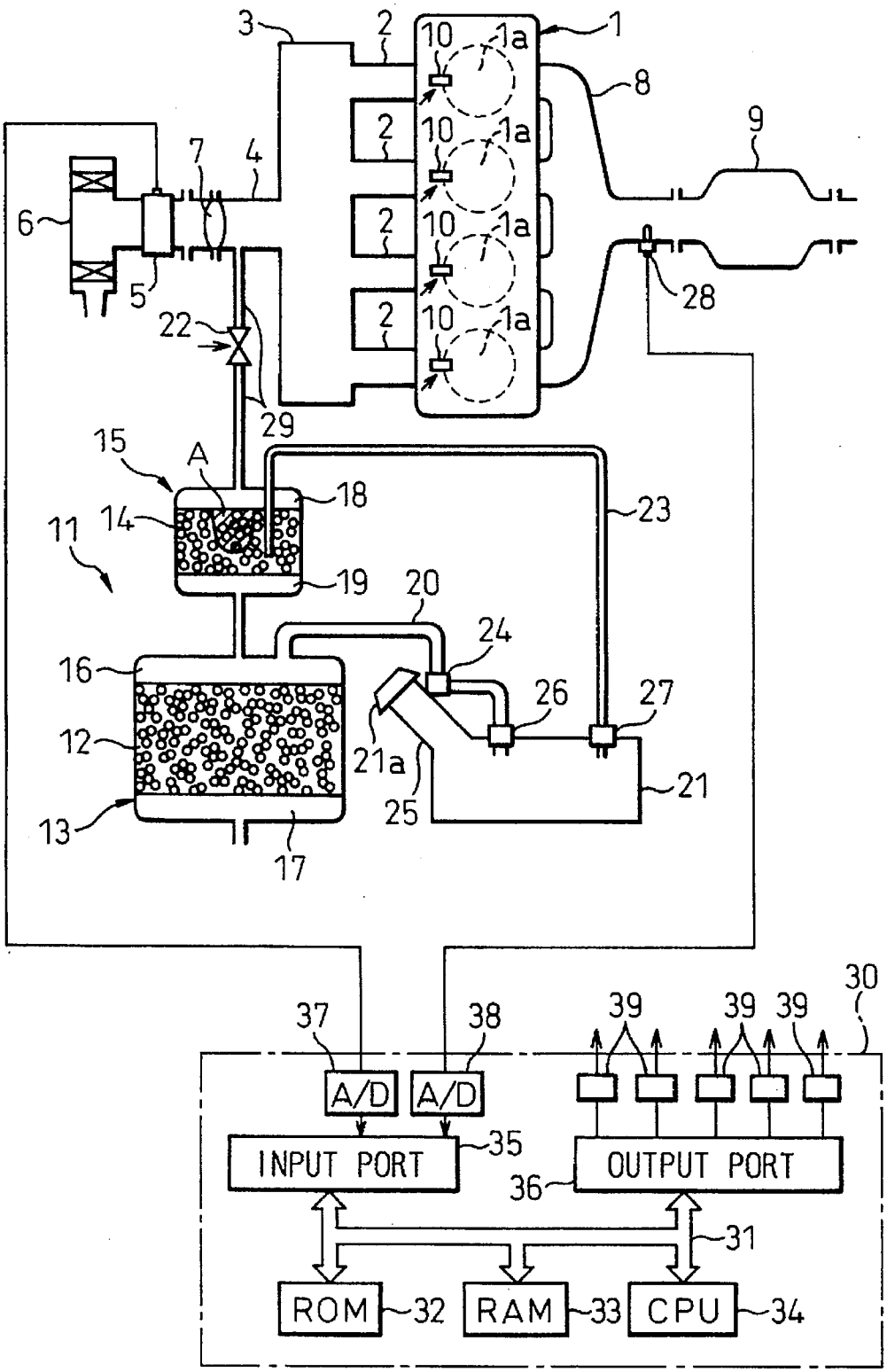
FIG. 1 shows an apparatus for controlling evaporated fuel of an internal combustion engine according to an embodiment of the present invention.

FIG. 1 shows an apparatus for controlling evaporated fuel of an internal combustion engine according to an embodiment of the present invention.

The engine 1 has four cylinders 1*a*. Each of the cylinders 1*a* has an intake branch 2 connected to a surge tank 3. The surge tank 3 is connected to an intake duct 4, which is connected to an airflow meter 5. The airflow meter 5 is connected to an air cleaner 6. A throttle valve 7 is disposed in the intake duct 4. An exhaust manifold 8 is connected to the cylinders 1*a* and to a catalytic converter 9. Each of the cylinders 1*a* has a fuel injector 10, which is controlled according to an output signal of the electronic controller 30.

The apparatus 11 for controlling evaporated fuel is attached to the intake duct 4. The apparatus 11 has a main canister 13 having a main adsorption layer 12 made of activated carbon and a sub-canister 15 having a sub-adsorption layer 14 made of activated carbon. The canisters 13 and 15 are connected in series. On the opposite sides of the adsorption layer 12, the main canister 13 has an outgoing chamber 16 and an incoming chamber 17. On the opposite sides of the adsorption layer 14, the sub-canister 15 has an outgoing chamber 18 and an incoming chamber 19. The incoming chamber 17 of the main canister 13 communicates with atmosphere. The outgoing chamber 16 of the main canister 13 is connected to the incoming chamber 19 of the sub-canister 15 and to a fuel tank 21 through a first path 20.

The outgoing chamber 18 of the sub-canister 15 is connected to a third path 29 having a solenoid valve 22, which is connected to the intake duct 4 on the downstream of the throttle valve 7. The duty factor of the solenoid valve 22 is controlled according to an output signal of the electronic controller 30, to adjust the quantity of evaporated fuel to be purged into the intake duct 4. Namely, the solenoid valve 22 is a purge control valve. A second path 23 guides, during the operation of the engine 1, evaporated fuel from the fuel tank 21 into the sub-adsorption layer 14. The cross-sectional area of the first path 20 is larger than that of the second path 23, and therefore, the flow resistance of the first path 20 is smaller than that of the second path 23.

The first path 20 has a vent valve 24 which opens the first path 20 only when the fuel tank 21 is replenished with fuel. When a cap 21*a* of the fuel tank 21 is removed to open a fuel path 25, the vent valve 24 opens the first path 20. When the cap 21*a* is attached to the fuel tank 21 to close the fuel path 25, the vent valve 24 closes the first path 20. It is possible to arrange a unit for detecting the removal of the cap 21*a* or the insertion of a filling nozzle into the fuel path 25, to operate the vent valve 24 accordingly. In the vicinities of the fuel tank 21, the first and second paths 20 and 23 have rollover valves 26 and 27, respectively, to prevent fuel from spilling from the fuel tank 21 when the vehicle is rolled over. An air-fuel ratio sensor 28 is arranged in the exhaust manifold 8.

The electronic controller 30 is a digital computer having a ROM 32, a RAM 33, a CPU 34, an input port 35, and an output port 36. These elements are connected to one another with a two-way bus 31. The airflow meter 5 generates a voltage in proportion to an intake air quantity Q. The voltage is supplied to the input port 35 through an AD converter 37. The air-fuel ratio sensor 28 generates a voltage, which is supplied to the input port 35 through an AD converter 38. The output port 36 is connected to the fuel injectors 10 and a purge control valve 22 through respective drive circuits 39.

A crank angle sensor (not shown) provides a signal that is used to calculate an engine speed N. The engine speed N, the intake air quantity Q provided by the airflow meter 5, and an air-fuel ratio detected by the air-fuel ratio sensor 28 are used to realize a target air-fuel ratio in the engine 1. The air-fuel ratio sensor 28 measures the concentration of oxygen in an exhaust gas.

Figure 2:
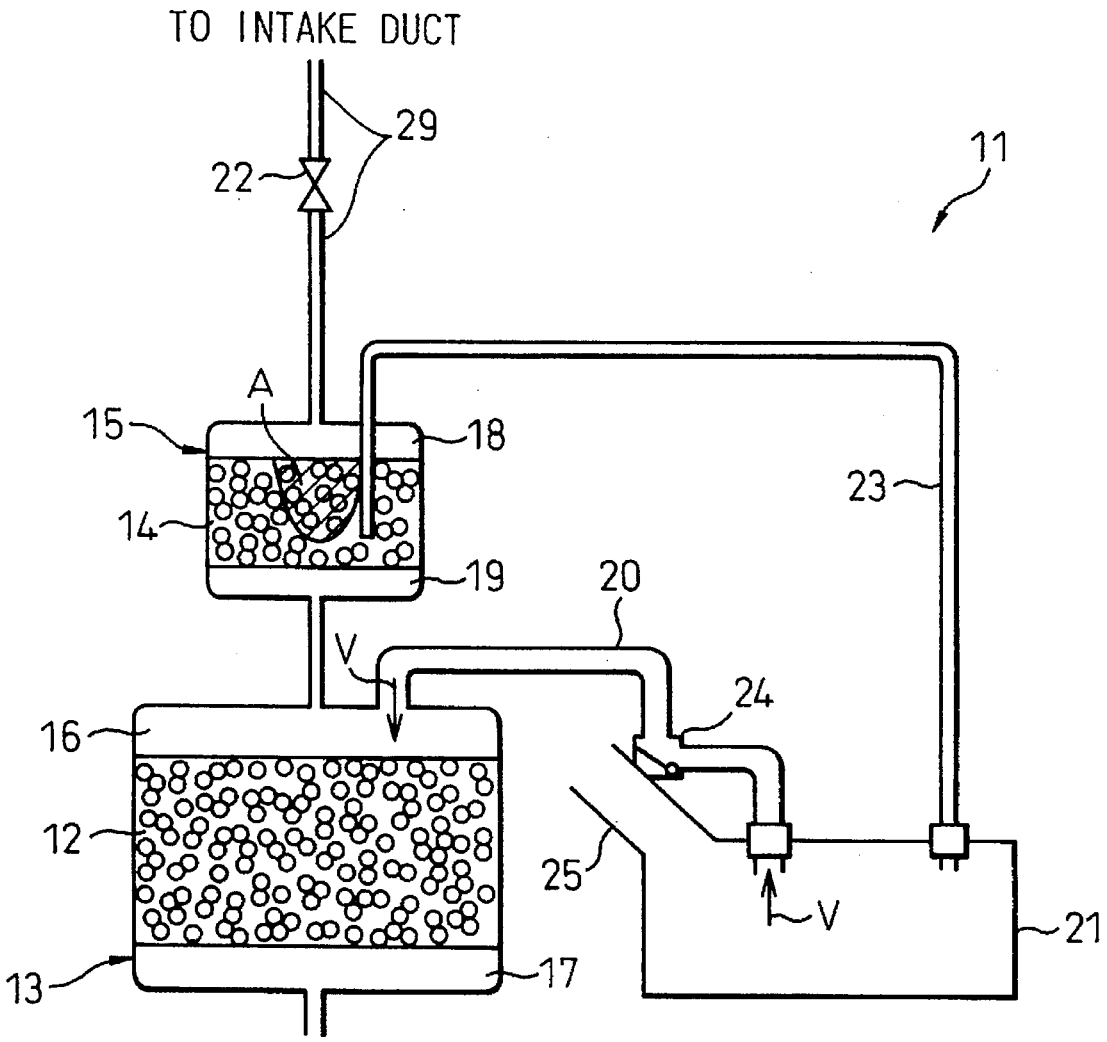
FIG. 2 explains the operation of the apparatus of FIG. 1 when filling a fuel tank with fuel.

The operation of the apparatus 11 for controlling evaporated fuel will be explained with reference to FIGS. 2 and 3. In FIG. 2, the cap 21*a* is removed from the fuel tank 21, and the fuel tank 21 is filled with fuel through the fuel path 25. Then, a large amount of evaporated fuel is produced in the fuel tank 21. At this time, the vent valve 24 is open. Since the flow resistance of the first path 20 is smaller than that of the second path 23, most of the evaporated fuel in the fuel tank 21 flows into the outgoing chamber 16 of the main canister 13 through the first path 20 as indicated with arrow marks V in FIG. 2. The evaporated fuel is then adsorbed by the adsorption layer 12 without flowing outside. While the fuel tank 21 is being filled with fuel, the purge control valve 22 is completely closed. When the filling of fuel is complete, the cap 21*a* is attached to the fuel tank 21 to close the fuel path 25 as well as the vent valve 24.

Figure 3:
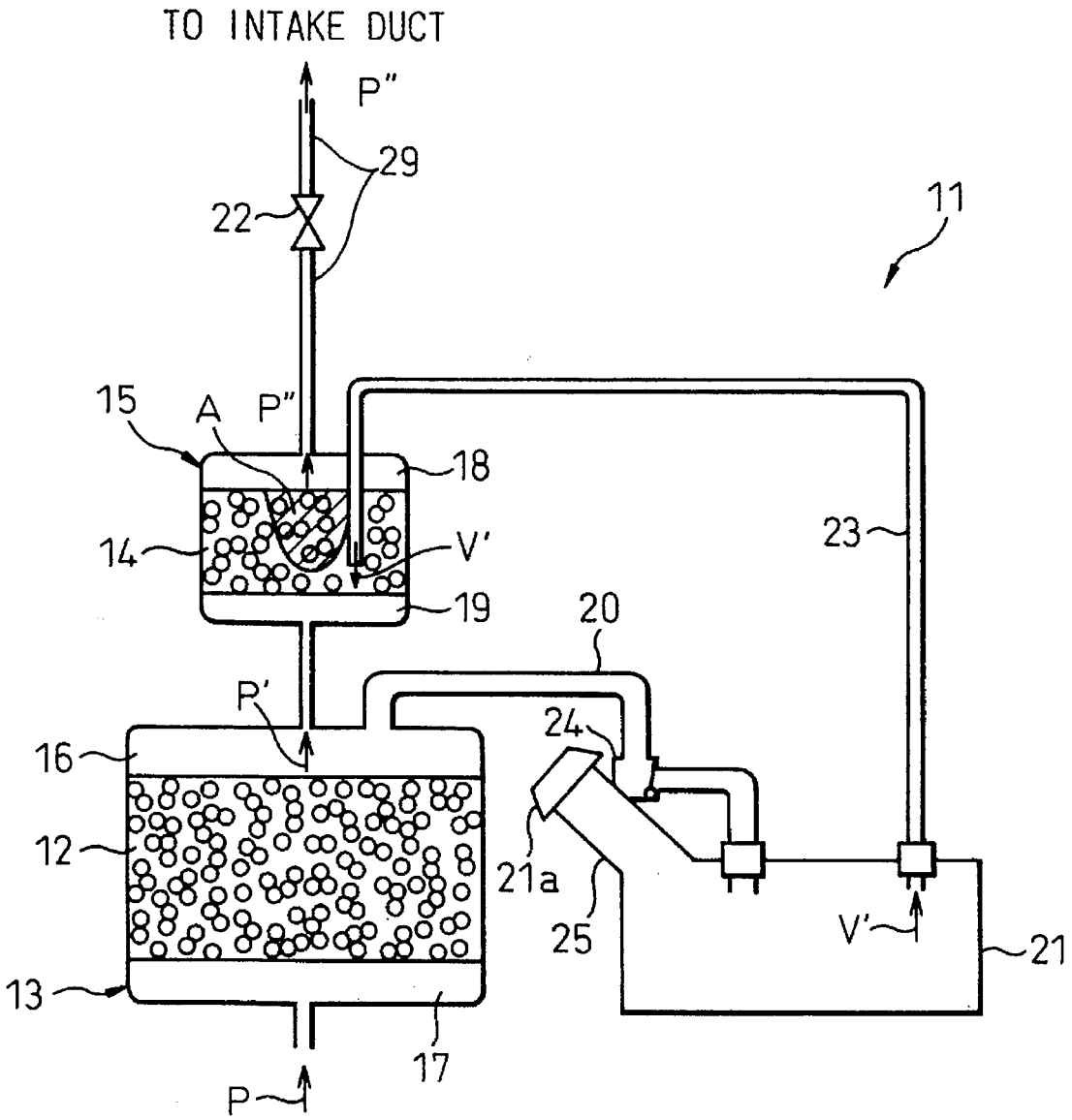
FIG. 3 explains the operation of the apparatus of FIG. 1 during the operation of the engine.

In FIG. 3, the engine 1 is started, and the intake duct 4 downstream from the throttle valve 7 produces a negative pressure. The purge control valve 22 is opened according to a duty factor, to purge evaporated fuel from the apparatus 11 into the engine 1. At the same time, air enters the incoming chamber 17 of the main canister 13 as indicated with an arrow mark P. The air passes through the adsorption layer 12 and releases fuel from the layer 12. The air and released fuel pass through the outgoing chamber 16 of the main canister 13 and the incoming chamber 19 of the sub-canister 15 and enter the adsorption layer 14 as indicated with an arrow mark P', which adsorbs the released fuel. At the same time, the air flowing into the adsorption layer 14 releases fuel from the adsorption layer 14. The air and released fuel pass through the outgoing chamber 18 and purge control valve 22 and enter the intake duct 4 as indicated with arrow marks P". The air and released fuel are then effectively used to generate the output torque of the engine 1.

Evaporated fuel produced in the fuel tank 21 during the operation of the engine 1 passes through the second path 23 and enters inside the sub-adsorption layer 14 as indicated with an arrow mark V'. The evaporated fuel is partly adsorbed by the layer 14 and is partly purged into the intake duct 4 through the purge control valve 22. In this way, evaporated fuel produced in the fuel tank 21 during the operation of the engine 1 bypasses the main adsorption layer 12 and passes the first path 23 into the sub-adsorption layer 14 from which the evaporated fuel is partly purged into the intake duct 4. Since evaporated fuel in the fuel tank 21 is always removed therefrom through the second path 23 during the operation of the engine 1, the pressure of the fuel tank 21 will never excessively increase to deform the fuel tank 21.

In this way, the fuel adsorbed by the adsorption layers 12 and 14 is gradually released therefrom and is purged into the engine 1. Finally, the adsorption layers 12 and 14 may hold no fuel and are restored to the original working capacities. Since evaporated fuel produced in the fuel tank 21 during the operation of the engine 1 bypasses the main adsorption layer 12, the working capacity of the layer 12 is secured.

A large amount of evaporated fuel produced during the filling of fuel into the fuel tank 21 is adsorbed by the main adsorption layer 12 as mentioned above. Accordingly, the layer 12 holds a lot of evaporated fuel just after the completion of the filling of fuel. When the engine 1 is started at this time, the layer 12 may release a large amount of evaporated fuel. If this fuel is purged into the intake duct 4, it will be difficult to maintain a target air-fuel ratio and a lot of unburned HC will be discharged into the exhaust manifold 8. To avoid this problem, the fuel released from the main adsorption layer 12 is guided to the sub-adsorption layer 14 and is temporarily adsorbed thereby. At the same time, the quantity of fuel purged from the layer 14 into the intake duct 4 is gradually increased as will be explained later. Consequently, a proper amount of evaporated fuel is purged into the engine 1. Since the sub-adsorption layer 14 adsorbs substantially no evaporated fuel during the filling of the fuel tank 21, the layer 14 may properly adsorb fuel released from the main adsorption layer 12 when the purge operation is restarted. In this way, the engine 1 receives a proper quantity of evaporated fuel.

When the engine 1 is stopped without replenishing the fuel tank 21 with fuel, evaporated fuel in the fuel tank 21 is adsorbed by the sub-adsorption layer 14 through the second path 23 as indicated with the arrow mark V' in FIG. 3. Since the quantity of evaporated fuel produced during the stoppage of the engine 1 without filling the fuel tank 21 is small, there will be no risk of deteriorating the working capacity of the sub-adsorption layer 14. The fuel adsorbed by the adsorption layers 12 and 14 is always released therefrom during the operation of the engine 1, to secure the working capacities of the layers 12 and 14.

A way of controlling the supply of fuel to the engine 1 will be explained. A fuel injection period TAU is calculated as follows:

$$TAU=TP\cdot\{1+\alpha+(FAF-1)+FPG\}$$

where TP is a basic fuel injection period, $\alpha$ is a correction coefficient, FAF is a feedback correction coefficient, and FPG is a purge correction coefficient.

The basic fuel injection period TP is determined to achieve a target air-fuel ratio and is empirically obtained. This period TP is stored in the ROM 32 as a function of an engine load Q/N (intake air quantity Q/engine speed N) and the engine speed N.

The correction coefficient $\alpha$ is the sum of various coefficients such as a warming-up coefficient and an acceleration coefficient. If none of them is required, the coefficient $\alpha$ is zero.

The purge correction coefficient FPG corrects a fuel injection quantity when fuel released from the adsorption layers 12 and 14 is purged into the intake duct 4. If there is no purge, the coefficient FPG is zero.

The feedback correction coefficient FAF is used to attain a target air-fuel ratio according to an output signal from the air-fuel ratio sensor 28. The target air-fuel ratio may be of any type. In the embodiment of FIG. 1, the target air-fuel ratio is a theoretical air-fuel ratio. Accordingly, the air-fuel ratio sensor 28 is an oxygen sensor whose output voltage is proportional to the concentration of oxygen in an exhaust gas. When an actual air-fuel ratio is rich, the oxygen sensor 28 provides an output voltage of about 0.9 V, and when it is lean, an output voltage of about 0.1 V . The output signal of the oxygen sensor 28 is used to control the feedback correction coefficient FAF. This will be explained first.

Figure 4:
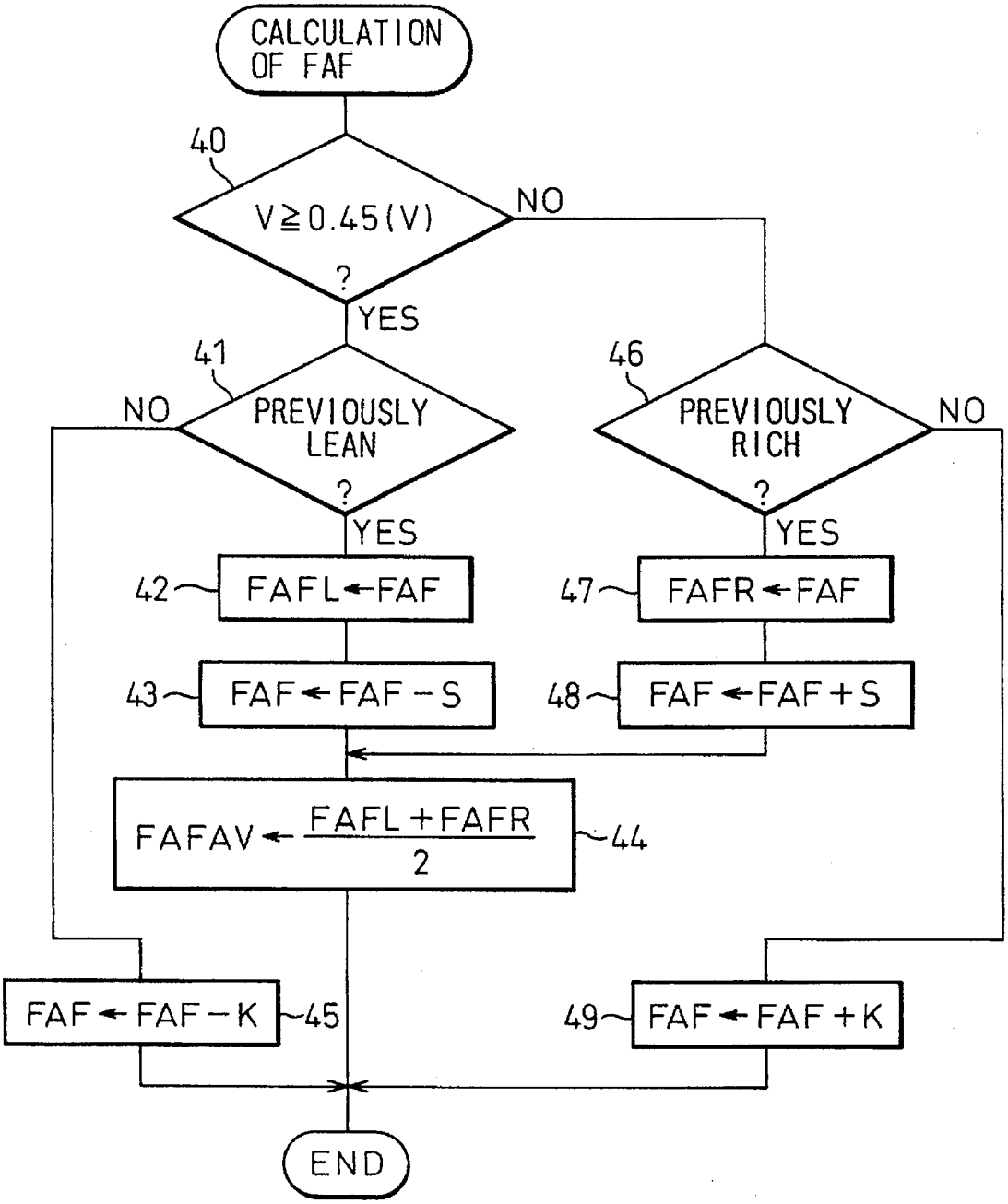
FIG. 4 is a flowchart showing a routine of calculating a feedback correction coefficient.
Figure 5:
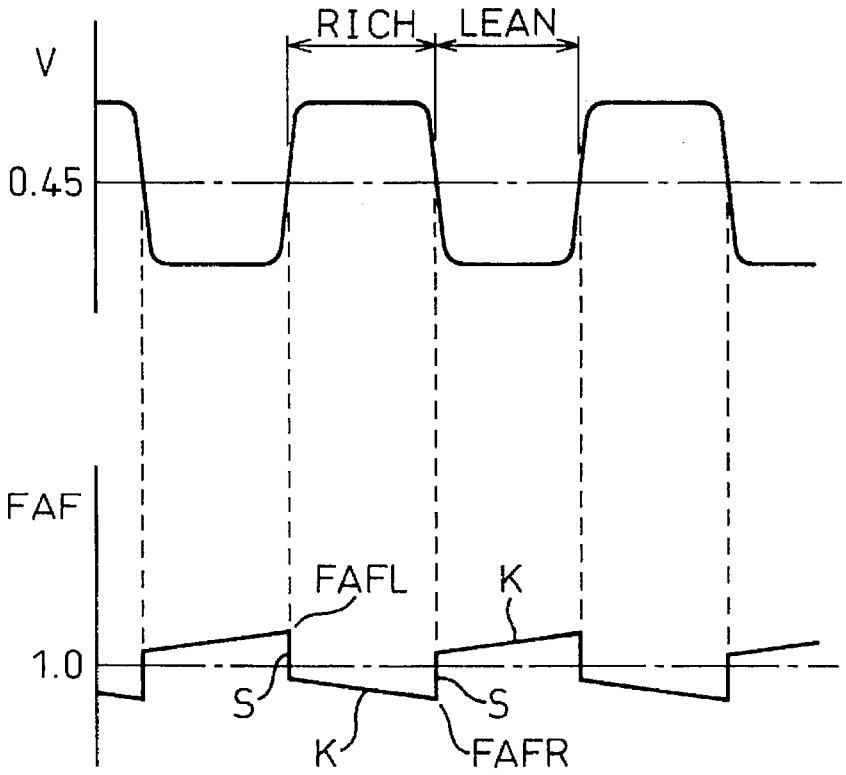
FIG. 5 is a time chart explaining air-fuel ratio feedback control.

FIG. 4 shows a routine of calculating the feedback correction coefficient FAF. This routine is executed in, for example, a main routine. Step 40 determines whether or not the output voltage of the oxygen sensor 28 is above 0.45 V, i.e., whether or not a current air-fuel ratio is rich. If $V \geqq 0.45$ V, i.e., if it is rich, step 41 determines whether or not a preceding cycle was lean. If it was lean, step 42 substitutes FAF for FAFL. Step 43 subtracts a skip value S from FAF. Namely, FAF is suddenly decreased by S as shown in FIG. 5. Step 44 calculates an average FAFAV of FAFL and FAFR. If step 41 determines that the preceding cycle was rich, step 45 subtracts an integral value K ($K \ll S$) from FAF. In this case, FAF is gradually decreased as shown in FIG. 5.

If $V<0.45$, i.e., if it is lean in step 40, step 46 determines whether or not the preceding cycle was rich. If it was rich, step 47 substitutes the feedback correction coefficient FAF for FAFR. Step 48 adds the skip value S to FAF. Namely, FAF is suddenly increased by S as shown in FIG. 5. Step 44 calculates an average FAFAV of FAFL and FAFR. If step 46 determines that the preceding cycle was lean, step 49 adds the integral value K to FAF. In this case, FAF is gradually increased as shown in FIG. 5.

If the air-fuel ratio is rich to decrease the feedback correction coefficient FAF, the fuel injection period TAU becomes shorter, and if it is lean to increase FAF, TAU becomes longer, to thereby attain a theoretical air-fuel ratio. When no purge action is carried out, FAF varies around 1.0 as shown in FIG. 5. The average FAFAV calculated in step 44 is an average of FAF.

As shown in FIG. 5, the feedback correction coefficient FAF is changed relatively slowly according to the integral constant K. Accordingly, if a large quantity of evaporated fuel is suddenly purged into the intake duct 4 to greatly change an air-fuel ratio, it will be impossible to keep a theoretical air-fuel ratio. This results in fluctuating the air-fuel ratio. To prevent this, the embodiment of FIG. 1 gradually increases the quantity of evaporated fuel to be purged into the intake duct 4. Then, the feedback control according to FAF properly works to maintain a theoretical air-fuel ratio and prevent a fluctuation in the air-fuel ratio.

Figure 6:
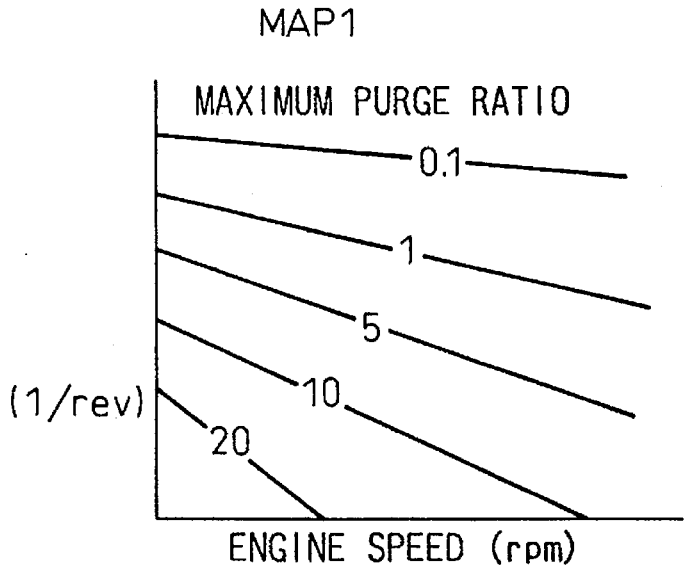
FIG. 6 shows a map for calculating a maximum purge ratio.

FIG. 6 shows examples of maximum purge ratios MAXPGs. The maximum purge ratio MAXPG is the ratio of the quantity of evaporated fuel to be purged to the quantity of intake air with the purge control valve 22 being fully opened. The ratio MAXPG is a function of an engine load Q/N and an engine speed N. The ratio MAXPG becomes larger as the engine load Q/N becomes smaller, or as the engine speed N becomes lower. When evaporated fuel is purged into the intake duct 4, a target purge ratio TGTPG is gradually increased at a fixed rate. When the ratio TGTPG reaches a given value, it is kept at the value, and the opening of the purge control valve 22 is controlled according to the ratio of TGTPG to MAXPG. The embodiment of FIG. 1 controls the duty factor of the purge control valve 22 according to the ratio of TGTPG to MAXPG.

When the engine 1 is decelerated, the fuel injector 10 is stopped. If evaporated fuel is purged into the intake duct 4 at this moment, the purged fuel will not be burned and will be discharged as it is into the exhaust manifold 8. To prevent this, the purge action must be stopped when the fuel injector 10 is stopped. When the fuel injector 10 is stopped, a cut flag is set, and when the cut flag is set, the purge action is stopped. A routine of controlling the cut flag will be explained with reference to FIG. 7.

Figure 7:
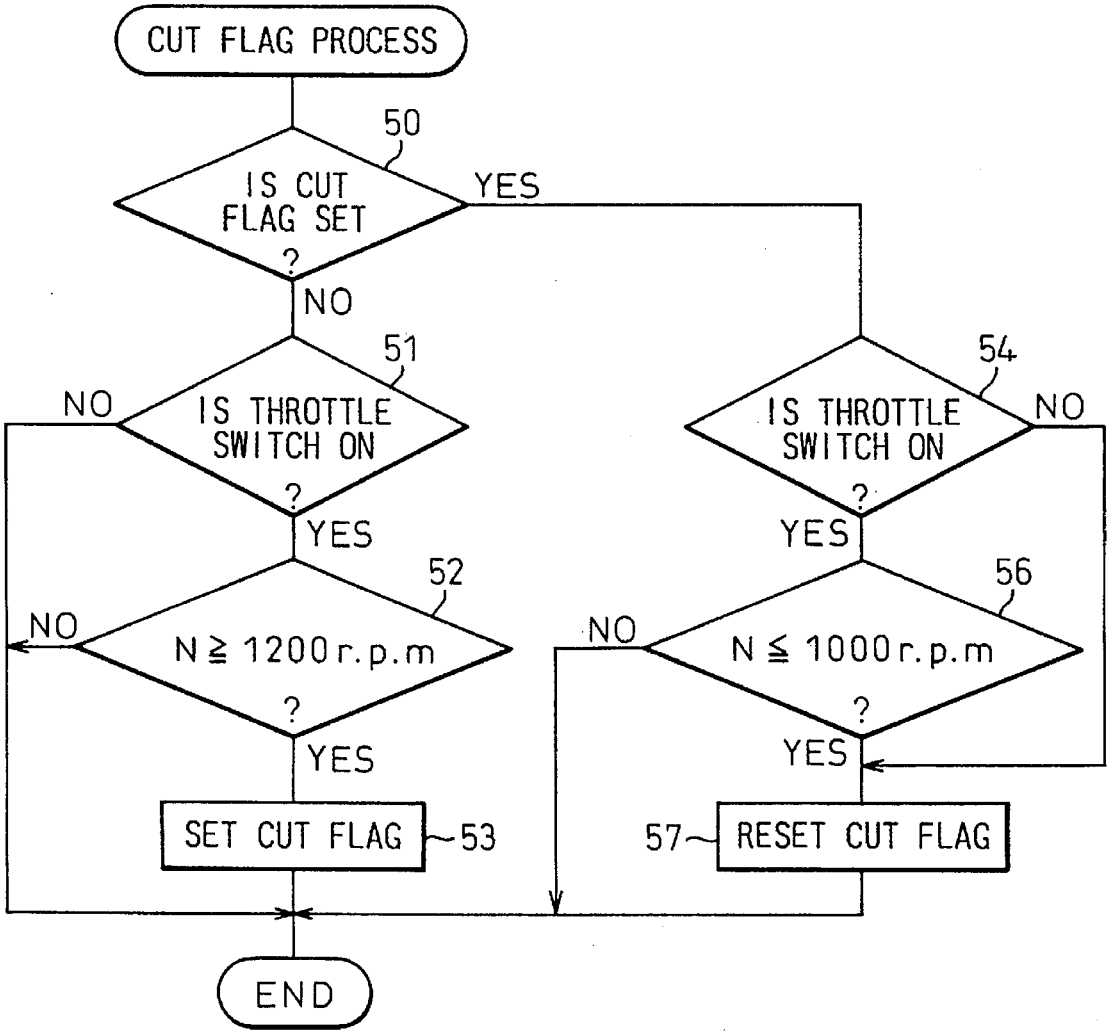
FIG. 7 is a flowchart showing a routine of processing a cut flag.

The routine of FIG. 7 is executed in, for example, the main routine. Step 50 determines whether or not the cut flag is set. If it is not set, step 51 determines whether or not a throttle switch (not shown) is ON, i.e., whether or not the throttle valve 7 is at an idling position. If it is at the idling position, step 52 determines whether or not an engine speed N is above, for example, 1200 r.p.m. If N≧1200 r.p.m., step 53 sets the cut flag. Namely, if the throttle valve 7 is at the idling position and N≧1200 r.p.m., it is determined that the engine 1 is decelerated, and the cut flag is set.

If step 50 determines that the cut flag is set, step 54 determines whether or not the throttle switch is ON, i.e., whether or not the throttle valve 7 is at the idling position. If it is at the idling position, step 56 determines whether or not the engine speed N is below 1000 r.p.m. If N≧1000 r.p.m., step 57 resets the cut flag. If step 54 determines that the throttle switch is OFF when the throttle valve 7 is opened, step 57 resets the cut flag. Once the cut flag is set, fuel injection is stopped. A method of controlling the purging of evaporated fuel will be explained in detail with reference to FIGS. 8 to 13.

Figure 8:
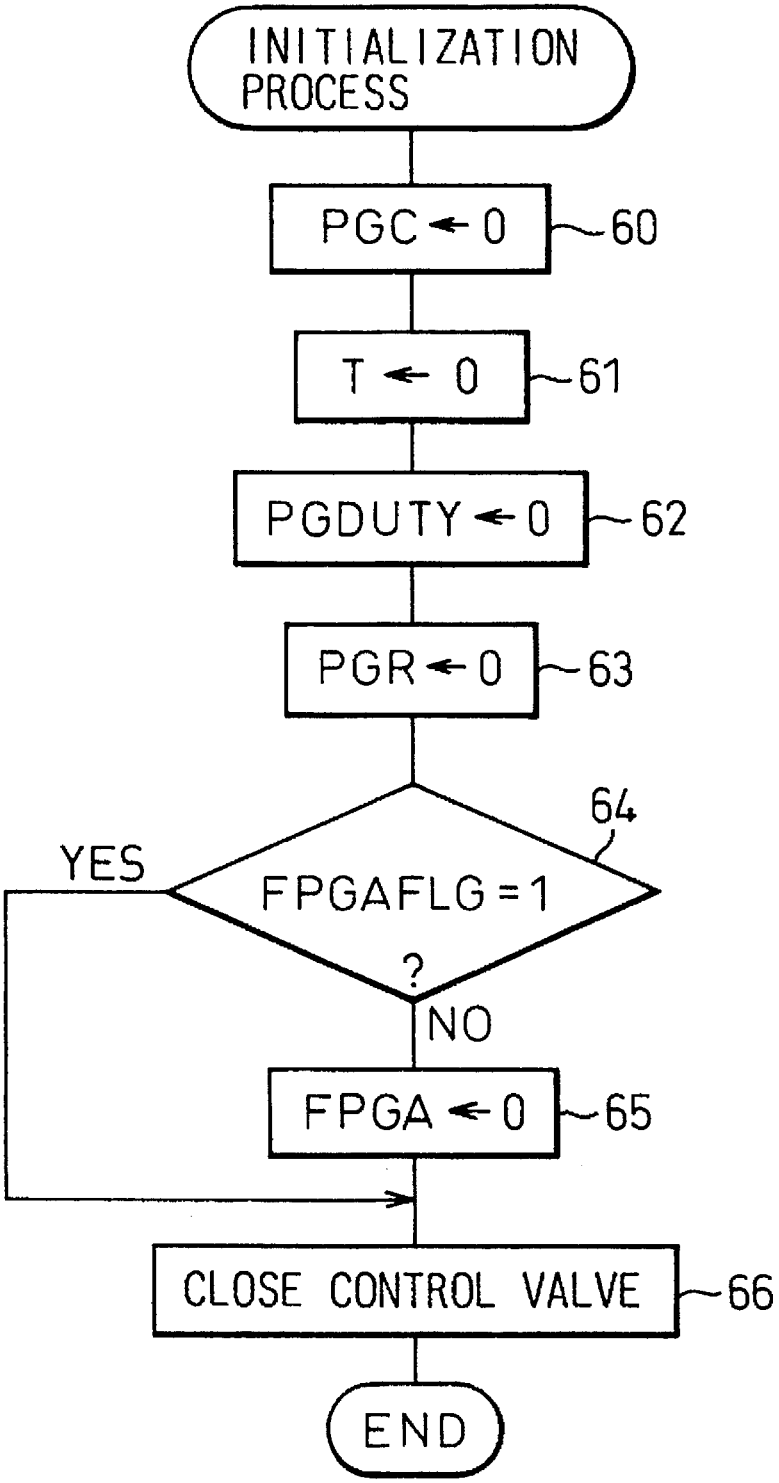
FIG. 8 is a flowchart showing an initialization routine.

FIG. 8 shows a routine of initializing purge control carried out when an ignition switch (not shown) is ON. Step 60 clears a purge count PGC. Step 61 clears a timer count T. Step 62 zeroes the duty factor PGDUTY of the purge control valve 22. Step 63 zeroes a purge ratio PGR. Step 64 determines whether or not a flag FPGAFLG is 1. This flag indicates, when it is 1, that a purged fuel concentration coefficient FPGA has been calculated. If step 64 provides YES, step 66 is carried out, and if NO, step 65 zeroes the coefficient FPGA. Step 66 closes the purge control valve 22, and the process ends.

Figure 9A:
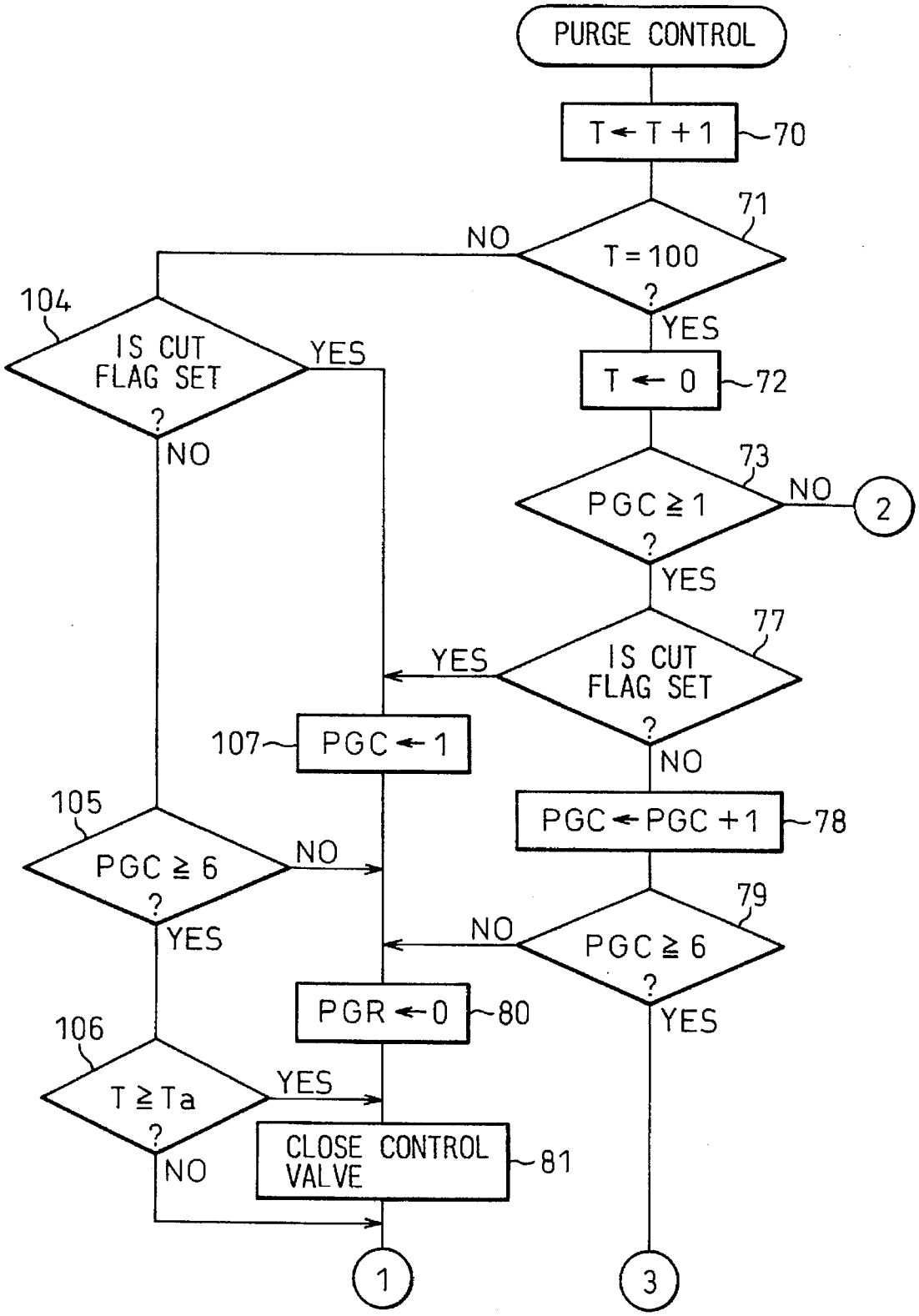
FIGS. 9A to 9D are flowcharts showing a purge control routine.
Figure 9B:
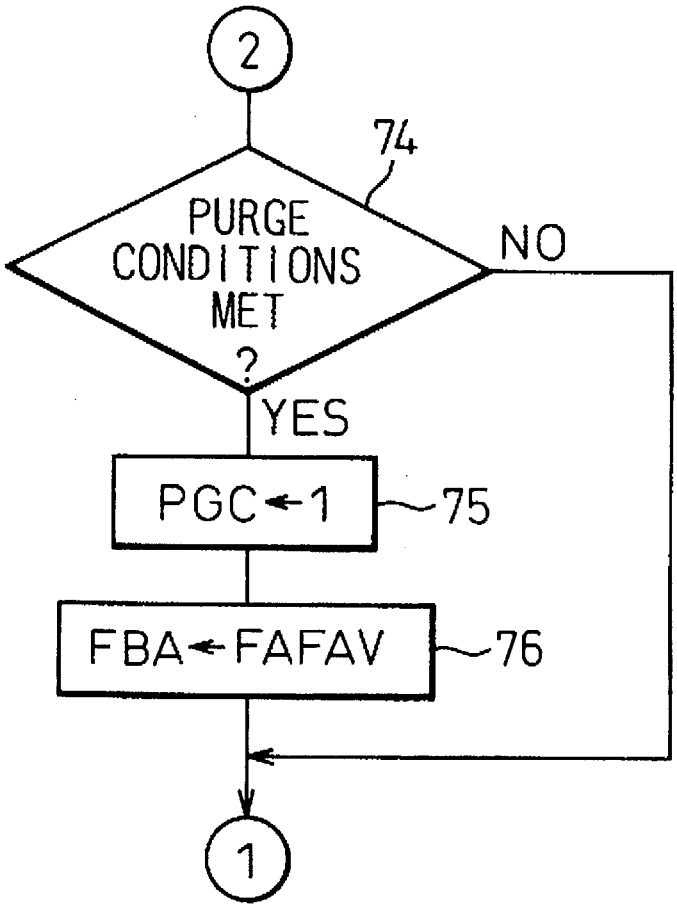

FIGS. 9A to 9D show the purge control routine, which is carried out in response to an interrupt that is produced at intervals of 1 msec. In FIG. 9A, step 70 increments the timer count T by one. Step 71 determines if T=100. If T=100, step 72 clears the timer count T. Namely, step 72 is carried out every 100 msec. Step 73 determines whether or not the purge count PGC is greater than one. When step 73 is carried out for the first time after the ignition switch is turned ON, the purge count PGC is zero, and therefore, step 74 of FIG. 9B is carried out.

Step 74 determines whether or not conditions to start the purge control are met. If the temperature of engine cooling water is 70 degrees centigrade or above, the feedback control of an air-fuel ratio has been started, and the feedback correction coefficient FAF has been adjusted by the skip value S (FIG. 5) at least five times, it is determined that the conditions to start the purge control are met. If these conditions are not met, the process ends. If these conditions are met, step 75 sets the purge count PGC to 1. Step 76 substitutes the average FAFAV calculated in the routine of FIG. 4 for a current average FBA, and the cycle ends. Namely, the average FBA represents the average FAFAV of the coefficient FAF when the conditions to start the purge control are met.

Figure 9C:
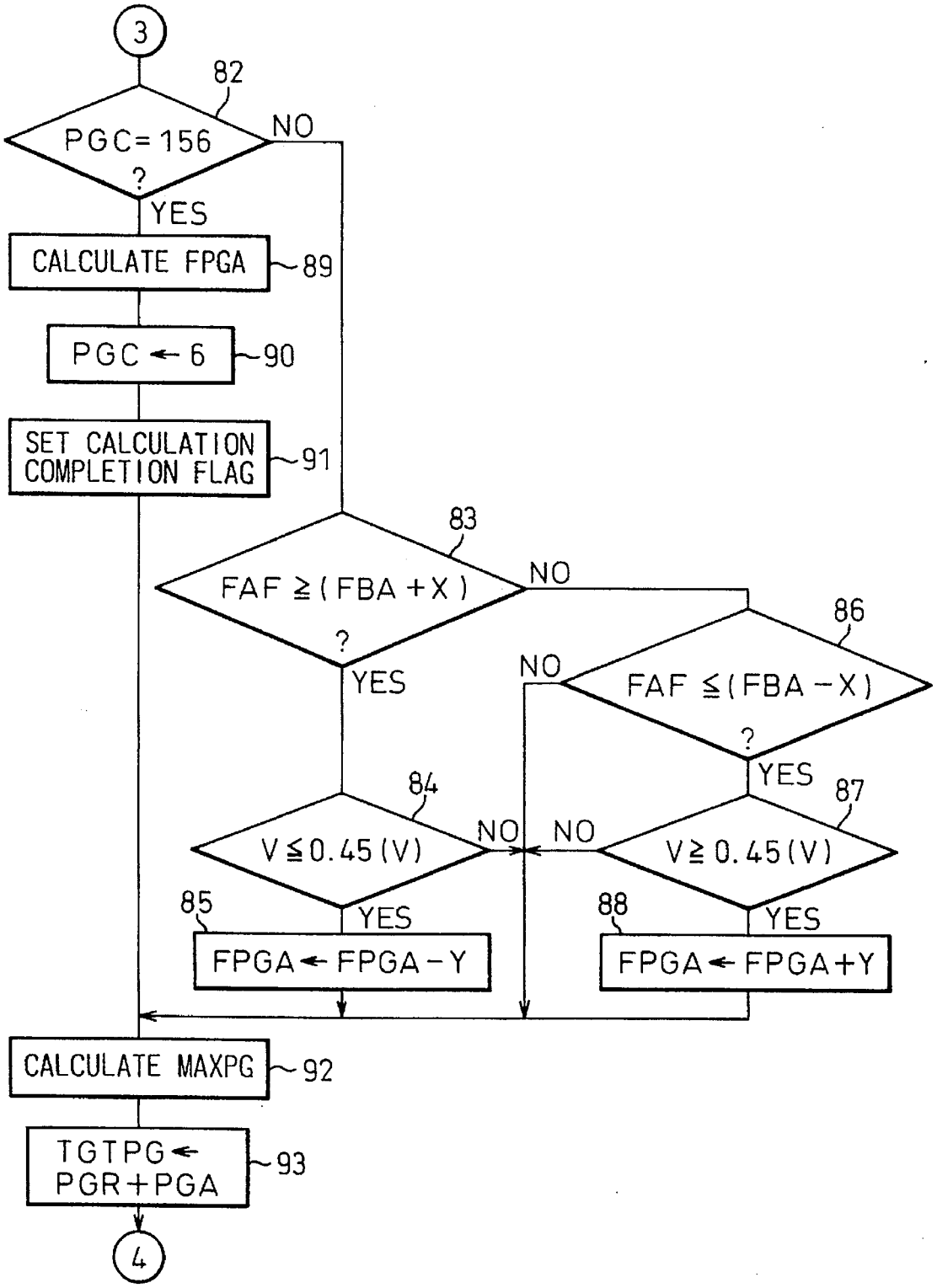

When the conditions to start the purge control are met, step 73 of FIG. 9A determines that PGC≧1. Then, step 77 determines whether or not the cut flag is set, i.e., whether or not fuel injection is stopped. If the cut flag is not set, step 78 increments the purge count PGC by one. Step 79 determines whether or not the purge count PGC is greater than six. If PGC<6, step 80 zeroes the purge ratio PRG, and step 81 closes the purge control valve 22. If the purge control valve 22 is already closed, it is kept closed. If PGC≧6 in step 79, i.e., if 500 msec has passed after repeating the purge control routine 500 times after the conditions to start the purge control were met, step 82 of FIG. 9C is carried out.

Steps 82 to 91 calculate the concentration of evaporated fuel to be purged, and these steps will be explained later. Step 92 calculates a maximum purge ratio MAXPG according to an engine load Q/N and an engine speed N with reference to the map 1 of FIG. 6. Step 93 calculates a target purge ratio TGTPG by adding a predetermined purge change rate PGA, for example, 0.01% to the purge ratio PGR. Namely, the target purge ratio TGTPG is incremented by PGA of, for example, 0.01 every 100 msec. The purge change rate PGA is to correct a time delay for purging evaporated fuel from the main canister 13 and the sub-canister 15 into the intake duct 4. By this correction, a measured evaporated fuel quantity purged will be equal to an actually purged quantity. The purge change rate PGA may be changed to, for example, 0.1 after the flag FPGAFLG is set to 1 upon the completion of the calculation of the purged fuel concentration coefficient FPGA. By changing the purge change rate PGA from 0.01 to 0.1, the period in which the target purge ratio TGTPG reaches a final target purge ratio of, for example, 5% will be shortened.

Figure 9D:
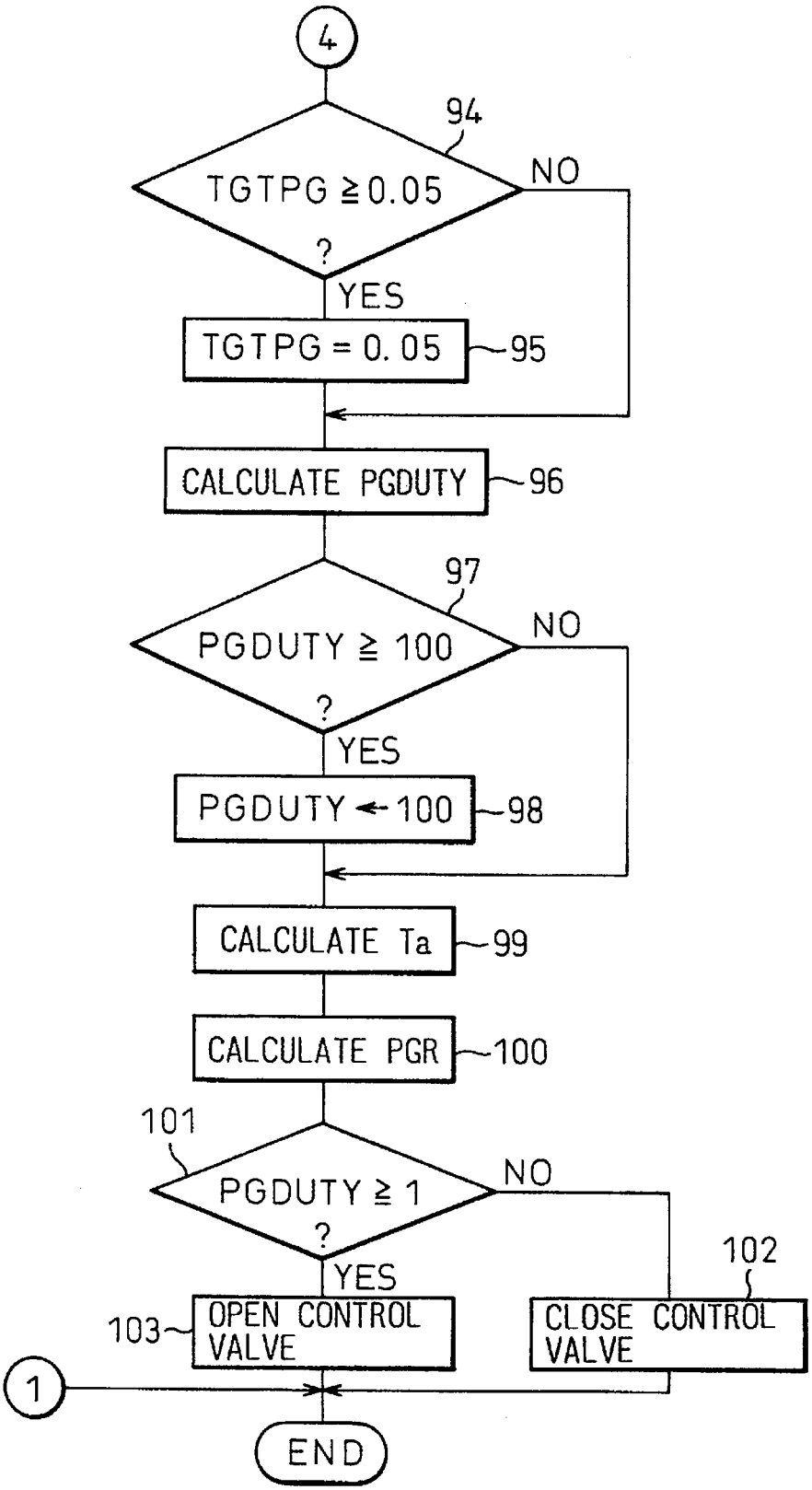
Figure 10:
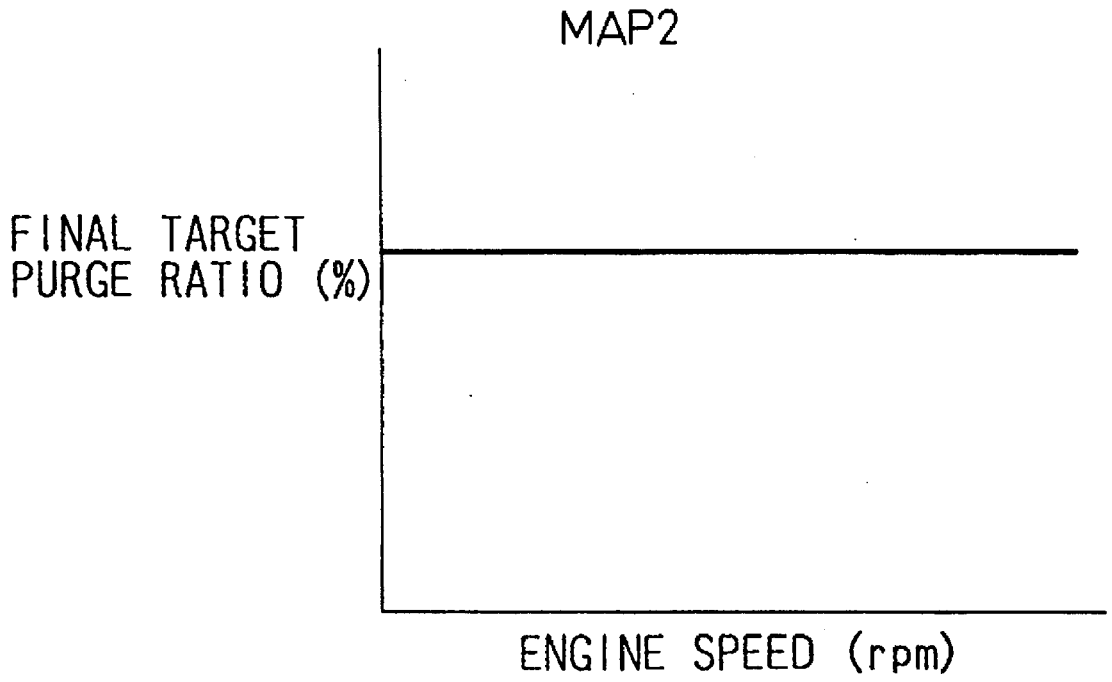
FIG. 10 shows a map for calculating a target purge ratio.

Step 94 of FIG. 9D determines whether or not the target purge ratio TGTPG is greater than a final target purge ratio of, for example, 0.05, i.e., 5%. This final target purge ratio is calculated according to the engine speed N with reference to a map 2 of FIG. 10. If TGTPG≧0.05, step 96 is carried out, and if TGTPG≧0.05, step 95 sets TGTPG=0.05.

Namely, the target purge ratio TGTPG is restricted not to exceed 5% because it is difficult to maintain a theoretical air-fuel ratio if TGTPG is very high to excessively increase the quantity of evaporated fuel to be purged.

Step 96 calculates the duty factor PGDUTY of the purge control valve 22 as follows:

$$PGDUTY=(TGTPG/MAXPG)\cdot 100$$

Step 98 determines whether or not the duty factor PGDUTY is greater than 100, i.e., 100%. If PGDUTY<100, step 99 is carried out, and if PGDUTY≧100, step 98 sets PGDUTY=100. Step 99 sets a timer count Ta for closing the purge control valve 22 according to the duty factor PGDUTY. Step 100 calculates an actual purge ratio PGR as follows:

$$PGR=(MAXPG\cdot PGDUTY)/100$$

If the duty factor PGDUTY calculated in step 96 exceeds 100 due to a decrease in the maximum purge ratio MAXPG in the expression "PGDUTY=(TGTPG/MAXPG)·100," the duty factor PGDUTY is set to 100 in step 98. In this case, the actual purge ratio PGR is smaller than the target purge ratio TGTPG. Namely, if the maximum purge ratio MAXPG decreases with the purge control valve 22 being fully opened, the actual purge ratio PGR decreases. Unless the duty factor PGDUTY calculated in step 96 exceeds 100, the actual purge ratio PGR will be equal to the target purge ratio TGTPG.

Step 101 determines whether or not the duty factor PGDUTY is greater than 1. If PGDUTY<1, step 102 closes the purge control valve 22, and the cycle ends. If PGDUTY≧1, step 103 opens the purge control valve 22, and the cycle ends.

In the next cycle, step 104 is carried out after step 71 of FIG. 9A, to determine whether or not the cut flag is set. If it is not set, step 105 determines whether or not the purge counter PGC is greater than six. Since PGC=6 at this time, step 106 determines whether or not the timer count T is greater than Ta. If T<Ta, the cycle ends, and if T≧Ta, the purge control valve 22 is closed. If the purge count PGC is greater than six, i.e., if 500 ms has passed after the start of the purge control, the purge control valve 22 is opened to purge evaporated fuel from the canisters 13 and 15 into the intake duct 4. At this time, the open period of the purge control valve 22 is equal to the duty factor PGDUTY. As the purge count PGC increases, the target purge ratio TGTPG becomes greater to increase the duty factor PGDUTY. This results in gradually increasing the quantity of evaporated fuel to be purged. If the intake air quantity Q increases, the maximum purge ratio MAXPG becomes smaller to increase the duty factor PGDUTY of the purge control valve 22 and the actual purge ratio PGR at a fixed rate.

The calculation of the purged fuel concentration coefficient FPGA of steps 82 to 91 of FIG. 9C will be explained. Step 82 determines whether or not the purge count PGC is equal to 156. If step 82 is carried out for the first time after the start of the purge control, PGC=6, and therefore, step 83 determines whether or not the feedback correction coefficient FAF is greater than an upper threshold FBA+X. The value FBA is the average FAFAV of the feedback correction coefficient FAF at the start of the purge control, as mentioned above. The value X is a small constant.

If FAF<FBA+X in step 83, step 86 determines whether or not the feedback correction coefficient FAF is below a lower threshold FBA−X. If FAF>FBA−X, step 92 is carried out, and if FAF≦FBA−X, step 87 determines whether or not the output voltage of the oxygen sensor 28 is higher than 0.45 V , i.e., whether or not a current air-fuel ratio is rich. If it is lean, step 92 is carried out, and if it is rich, step 88 adds a constant Y to the purged fuel concentration coefficient FPGA. Thereafter, step 92 is carried out. In this way, if FAF ≦FBA−X and if the air-fuel ratio is rich, FPGA is increased by Y.

If FAF≧FBA+X in step 83, step 84 determines whether or not the output voltage of the oxygen sensor 28 is below 0.45 V, i.e., if the air-fuel ratio is lean. If it is rich, step 92 is carried out, and if it is lean, step 85 subtracts the constant Y from the purged fuel concentration coefficient FPGA. Thereafter, step 92 is carried out. Namely, if FAF≧FBA+X and if the air-fuel ratio is lean, FPGA is decreased by Y. As a result, the air-fuel ratio will not fluctuate when the feedback correction coefficient FAF exceeds the upper threshold FBA+X.

If PGC=156 in step 82, i.e., if 15 seconds has passed after step 82 is carried out for the first time, step 89 calculates the purged fuel concentration coefficient FPGA as follows:

$$FPGA=FPGA-(FAFAV-FBA)/PGR\cdot 2$$

Namely, a deviation per unit purge ratio PGR between a current average feedback correction coefficient FAFAV and the average feedback correction coefficient FBA at the start of the purge control is halved and subtracted from the purged fuel concentration coefficient FPGA. In other words, half of a change in the feedback correction coefficient FAF per unit purge ratio PGR is subtracted from the purged fuel concentration coefficient FPGA. When FAFAV becomes smaller than FBA, FPGA increases. Step 90 sets the purge count PGC to 6. Namely, step 89 is carried out every 15 seconds. Step 91 sets the flag FPGAFLG to 1 to indicate that the purged fuel concentration coefficient FPGA has been calculated. Thereafter, step 92 is carried out. Once the flag FPGAFLG is set to 1 in the first purge control carried out in the first use of the engine 1, the flag is kept at 1 until the voltage of a battery decreases below a reference value. When the battery voltage drops below the reference value, the flag FPGAFLG is reset to 0. Namely, the purged fuel concentration coefficient FPGA is not reset during a normal operation of the engine 1 once the flag FPGAFLG is set to 1, and the coefficient FPGA holds data calculated in the preceding cycle. Accordingly, the purge correction coefficient FPG is quickly and correctly calculated when calculating the fuel injection period TAU after the purge operation is restarted. The feedback control of an air-fuel ratio, therefore, is properly carried out.

If step 77 or 104 of FIG. 9A determines that the cut flag is set, step 107 sets the purge count PGC to 1, and step 80 zeroes the purge ratio PGR. Thereafter, step 81 closes the purge control valve 22. In this way, the purge action is stopped when the cut flag is set. When the purge count PGC again reaches 6, the purge action is restarted.

Figure 11:
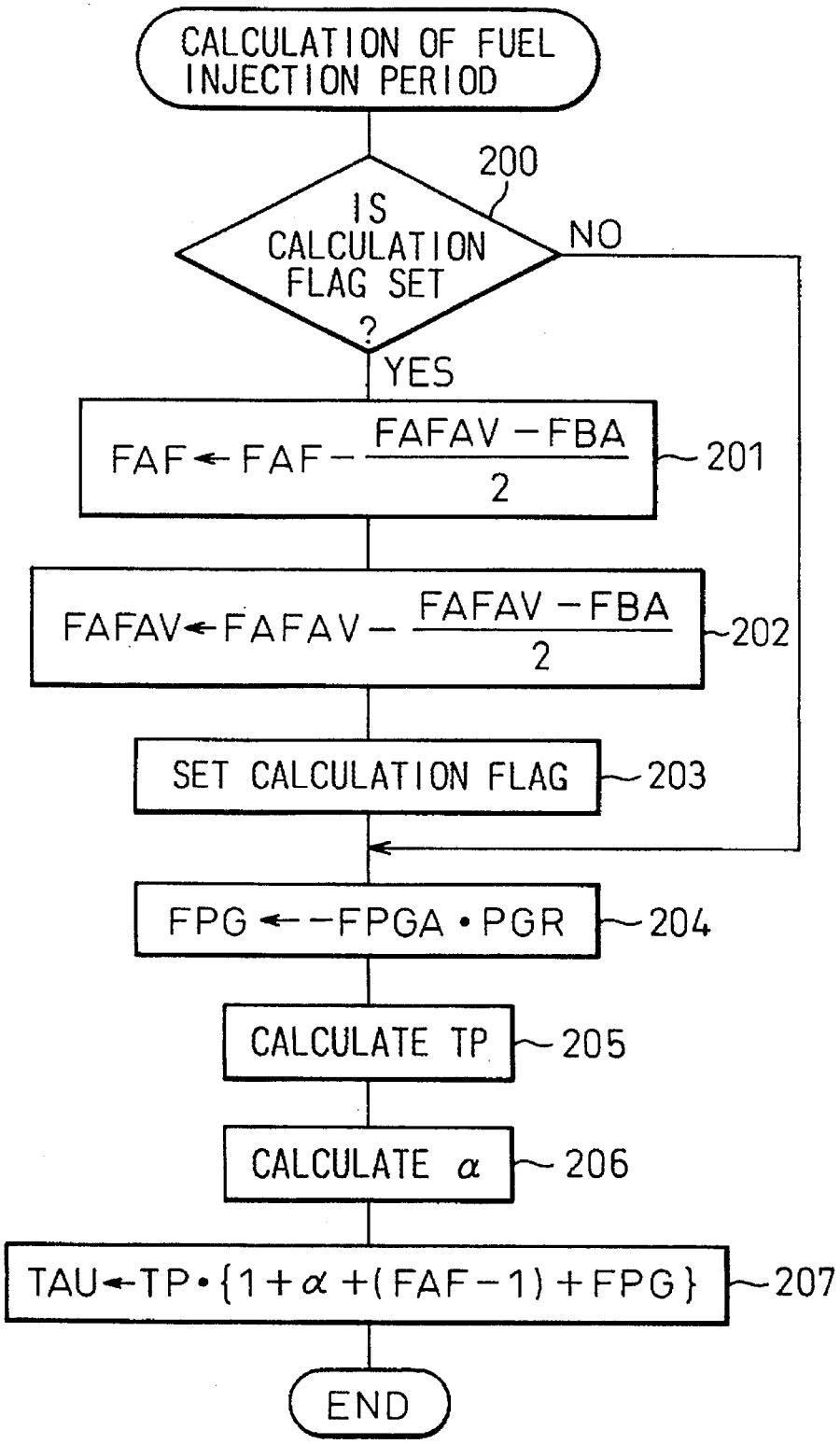
FIG. 11 is a flowchart showing a routine for calculating a fuel injection period.

FIG. 11 is a flowchart showing a routine of calculating the fuel injection period TAU. This routine is executed by an interrupt that occurs at every predetermined crank angle. Step 200 determines whether or not a calculation flag is set. If the flag is not set, step 204 is carried out. If the flag is set, step 201 halves a deviation between a current average feedback correction coefficient FAFAV and the average feedback correction coefficient FBA at the start of the purge control and subtracts the calculated half from the feedback correction coefficient FAF. This process is carried out at intervals of 15 seconds because the calculation flag is set every 15 seconds. If FAFAV is smaller than FBA, FAF is increased by half of a decrease in FAF every 15 seconds. At this time, the purged fuel concentration coefficient FPGA is increased according to the increase in the coefficient FAF.

To change FAFAV according to the change in FAF, step 202 subtracts (FAFAV−FBA)/2 from FAFAV. Step 203 resets the calculation flag. Step 204 calculates the purge correction coefficient FPG as follows:

$$FPG=-(FPGA\cdot PGR)$$

Step 205 calculates a basic fuel injection period TP, and step 206 calculates a correction coefficient α. Step 207 calculates the fuel injection period TAU as follows:

$$TAU=TP\cdot\{1+\alpha+(FAF-1)+FPG\}$$

According to the fuel injection period TAU, the fuel injector 10 injects fuel.

As explained above, the present invention provides an apparatus for controlling the evaporated fuel of an internal combustion engine which is capable of securing the working capacities of canisters and properly carrying out the feedback control of an air-fuel ratio when a purge action of evaporated fuel is resumed.

It will be understood by those skilled in the art that the foregoing description is a preferred embodiment of the disclosed device and that various changes and modifications may be made in the invention without departing from the spirit and scope thereof.

We claim:

1. An apparatus for controlling evaporated fuel of an internal combustion engine, having first and second canisters for adsorbing evaporated fuel produced in a fuel tank, the first and second canisters being connected in series between an atmospheric hole of the first canister and an intake duct of the engine, air entering the atmospheric hole passing through the first and second canisters and releasing the fuel adsorbed by the first and second canisters, the air and released fuel being purged into the intake duct, comprising:

a first path for guiding evaporated fuel from the fuel tank to the first canister when the fuel tank is replenished with fuel;

a second path for guiding evaporated fuel from the fuel tank into an adsorption material disposed in the second canister during the operation of the engine, wherein the evaporated fuel leaves the second path and enters the adsorption material at a location sufficiently separated from a downstream surface thereof so that the fuel adsorption state of a portion of the adsorption material of the second canister adjacent to an outlet from the second canister to a path for purging air and fuel from the second canister into the intake duck is substantially unchanged between a given purge operation and the next purge operation; and fuel supply control means for calculating, at a second purge operation, a fuel injection quantity to achieve a target air-fuel ratio according to a concentration of purged fuel of a first purge operation.

2. In an internal combustion engine having first and second canisters for adsorbing evaporated fuel produced in a fuel tank, the canisters being connected in series between an atmospheric hole of the first canister and an intake duct of the engine so that air from the atmospheric hole passes through the canisters and releases the fuel adsorbed by the canisters and so that the air and released fuel are purged into the intake duct, a method of controlling evaporated fuel comprising the steps of:

guiding, while the fuel tank is being replenished with fuel, evaporated fuel from the fuel tank to the first canister through a first path;

guiding, during operation of the engine, evaporated fuel from the fuel tank into an adsorption material disposed in the second canister through a second path, wherein the evaporated fuel is guided through the second path to enter the adsorption material at a location sufficiently separated from a downstream surface of the adsorption material so that the fuel adsorption state of a portion of the adsorption material in the second canister adjacent to an outlet from the second canister to a path for purging air and fuel from the second canister into the intake duct is substantially unchanged between a given purge operation and the next purge operation; and using a concentration of purged fuel of a first purge operation when calculating, at a second purge operation, a fuel injection quantity to achieve a target air-fuel ratio.

* * * * *